US007740341B2

(12) United States Patent
Lee et al.

(10) Patent No.: US 7,740,341 B2
(45) Date of Patent: Jun. 22, 2010

(54) INKJET PRINTHEAD

(75) Inventors: Francis Chee-Shuen Lee, Hsinchu (TW); Ming-Ling Lee, Hsinchu (TW); Wei-Fu Lai, Taichung (TW); Jia-Lin Chen, Hsinchu (TW)

(73) Assignee: International United Technology Co., Ltd., Hsin-Chu (TW)

( * ) Notice: Subject to any disclaimer, the term of this patent is extended or adjusted under 35 U.S.C. 154(b) by 828 days.

(21) Appl. No.: 11/623,324

(22) Filed: Jan. 16, 2007

(65) Prior Publication Data

US 2007/0268336 A1 Nov. 22, 2007

(30) Foreign Application Priority Data

May 19, 2006 (TW) ..... 95117815 A

(51) Int. Cl.
*B41J 2/05* (2006.01)

(52) U.S. Cl. ..... 347/56

(58) Field of Classification Search ..... 347/17, 347/20, 29, 40–44, 47, 54, 56, 61–63
See application file for complete search history.

(56) References Cited

U.S. PATENT DOCUMENTS

| | | | | |
|---|---|---|---|---|
| 5,871,656 | A | 2/1999 | Silverbrook | |
| 6,000,787 | A | 12/1999 | Weber et al. | |
| 6,158,845 | A | 12/2000 | Chwalek et al. | |
| 6,203,145 | B1 | 3/2001 | Jeanmaire et al. | |
| 6,209,203 | B1 | 4/2001 | Murthy et al. | |
| 6,217,156 | B1 | 4/2001 | Hawkins et al. | |
| 6,217,163 | B1 | 4/2001 | Anagnostopoulos et al. | |
| 6,254,225 | B1 | 7/2001 | Chwalek et al. | |
| 6,260,957 | B1 | 7/2001 | Corley, Jr. et al. | |
| 6,336,714 | B1 | 1/2002 | Kawamura et al. | |
| 6,402,301 | B1 | 6/2002 | Powers et al. | |
| 6,402,972 | B1 | 6/2002 | Weber et al. | |
| 6,554,404 | B2 | 4/2003 | Giere et al. | |
| 6,561,626 | B1 | 5/2003 | Min et al. | |
| 6,616,268 | B2 | 9/2003 | Parish | |
| 6,787,050 | B2 | 9/2004 | Parish | |
| 7,018,021 | B2 | 3/2006 | Silverbrook | |
| 7,581,809 | B2 * | 9/2009 | Eguchi et al. | 347/20 |
| 7,637,597 | B2 * | 12/2009 | Iwata | 347/56 |
| 7,661,798 | B2 * | 2/2010 | Mukai et al. | 347/56 |
| 2004/0017441 | A1 | 1/2004 | Shin et al. | |

FOREIGN PATENT DOCUMENTS

| | | |
|---|---|---|
| EP | 1484178 | 12/2004 |

* cited by examiner

*Primary Examiner*—K. Feggins
(74) *Attorney, Agent, or Firm*—Jianq Chyun IP Office

(57) ABSTRACT

An inkjet printhead including a substrate, a plurality of heaters, multiple pairs of leads, an ink chamber layer, and a nozzle plate is provided. The substrate has a top surface and a plurality of ink channels through the substrate in the direction substantially vertical to the top surface. The heaters, the multiple pairs of leads, and the ink chamber layer are disposed on the surface of the substrate. The multiple pairs of leads are electrically coupled to the corresponding heaters respectively, and the heaters are respectively adjacent to the corresponding ink channels. The ink chamber layer has a plurality of ink chambers which respectively expose the corresponding heaters and the corresponding ink channels. The nozzle plate is disposed on the ink chamber layer and has a plurality of nozzles through the nozzle plate.

23 Claims, 5 Drawing Sheets

200

200

INKJET PRINTHEAD

CROSS-REFERENCE TO RELATED APPLICATION

This application claims the priority benefit of Taiwan application serial no. 95117815, filed on May 19, 2006. All disclosure of the Taiwan application is incorporated herein by reference.

BACKGROUND OF THE INVENTION

1. Field of the Invention

The present invention relates to an inkjet printhead. More particularly, the present invention relates to an inkjet printhead with a plurality of ink channels through a substrate.

2. Description of Related Art

Inkjet printing technique has been broadly applied to printing equipments. According to the inkjet printing technique, droplets of ink is jetted onto a print medium to form ink dots on the print medium by a high pressure produced by actuators of a printhead (i.e. inkjet chip), accordingly an image or text is formed on the print medium by these ink dots. The most popular inkjet printing techniques include piezoelectric inkjet printing and thermal bubble inkjet printing. According to thermal bubble inkjet printing, ink is vaporized instantaneously by heaters (heating resistor) in the inkjet printhead for producing high-pressure bubbles, and the ink is then ejected through nozzles to form droplets of ink.

Specifically, in an existing thermal bubble inkjet printhead, a plurality of horizontal ink flow channels and ink chambers are usually formed with an ink chamber layer disposed on a substrate. The horizontal ink flow channels are formed in the ink chamber layer. Ink is vertically supplied to these horizontal ink flow channels via an elongated ink slot which is through the substrate and then enters the corresponding ink chambers through these horizontal ink flow channels. After that, the ink is vaporized by heaters disposed on the surface of the substrate and exposed by the ink chambers so that the ink is ejected through a plurality of nozzles on a nozzle plate disposed on the ink chambers to form droplets of ink.

It should be noted here that in an existing thermal bubble inkjet printhead, the elongated ink slot occupies a certain proportion of surface area of the substrate of the inkjet printhead, and relative long and horizontal ink flow channels are required for the ink to flow from the elongated ink slot into the heaters through the horizontal ink flow channels. The horizontal ink flow channels are disposed on the substrate, and are formed, for example, with the ink chamber layer. Thus, a lot of surface areas of the substrate of the inkjet printhead is taken by the elongated ink slot so that the number of heaters within the same surface area of the inkjet chip is limited, which in turn restricts the inkjet printhead from being developed towards high printing resolution, high printing speed, and low manufacturing cost.

SUMMARY OF THE INVENTION

Accordingly, the present invention is directed to provide an inkjet printhead for improving printing resolution.

According to another aspect of the present invention, an inkjet printhead is provided for improving printing speed.

According to another aspect of the present invention, an inkjet printhead is provided for reducing waste of the surface area of a substrate.

Other objectives, features and advantages of the present invention will be further understood from the further technology features disclosed by the embodiments of the present invention wherein there are shown and described preferred embodiments of this invention, simply by way of illustration of the modes best suited to carry out the invention. As it will be realized, the invention is capable of different embodiments, and its several details are capable of modifications in various, obvious aspects all without departing from the invention. Accordingly, the drawings and descriptions will be regarded as illustrative in nature and not as restrictive.

In order to achieve one, some or all of the aforementioned objects or other objects, the present invention provides an embodiment of an inkjet printhead including a substrate, a plurality of heaters, a plurality of pairs of leads, and a nozzle plate. The substrate has a surface and a plurality of ink channels through the substrate in the direction substantially vertical to the surface. The heaters are disposed on the surface of the substrate and are respectively adjacent to the corresponding ink channels. The pairs of leads are disposed on the surface of the substrate and are respectively electrically coupled to the corresponding heaters for conducting current into and out of the corresponding heaters respectively. The part of the pair of leads for conducting current into the corresponding heater and the part of the pair of leads for conducting current out of the same corresponding heater are located between adjacent two of the ink channels. The nozzle plate is disposed on the surface of the substrate and has a plurality of nozzles through the nozzle plate, and the positions of the nozzles are respectively corresponding to the positions of the heaters.

The present invention provides another embodiment of an inkjet printhead including a substrate, a plurality of heaters, a plurality of pairs of leads, and a nozzle plate. The substrate has a surface and a plurality of ink channels through the substrate in the direction substantially vertical to the surface. The heaters are disposed on the surface of the substrate and are respectively adjacent to the corresponding ink channels. The pairs of leads are disposed on the surface of the substrate and are respectively electrically coupled to the heaters for conducting current into and out of the corresponding heaters respectively. The nozzle plate is disposed on the surface of the substrate and has a plurality of nozzles through the nozzle plate, and the positions of the nozzles are respectively corresponding to the positions of the heaters.

The present invention provides further another embodiment of an inkjet printhead including a substrate, a plurality of heaters, a plurality of pairs of leads, and a nozzle plate. The substrate has a surface and a plurality of ink channels through the substrate in the direction substantially vertical to the surface. The heaters are disposed on the surface of the substrate and are respectively adjacent to the corresponding ink channels. The pairs of leads are disposed on the surface of the substrate and are respectively electrically coupled to the corresponding heaters for conducting current into and out of the corresponding heaters respectively. Parts of a certain pair of leads electrically coupled to the same heater for conducting current into and out of the heater and the heater itself surround the corresponding ink channel at least in part. The nozzle plate is disposed on the surface of the substrate and has a plurality of nozzles through the nozzle plate, and the positions of the nozzles are respectively corresponding to the positions of the heaters.

The present invention provides another embodiment of an inkjet printhead including a substrate, a plurality of heaters, a plurality of pairs of leads, and a nozzle plate. The substrate has a surface and a plurality of ink channels through the substrate in the direction substantially vertical to the surface. The heaters are disposed on the surface of the substrate and are respectively adjacent to the corresponding ink channels. The pairs of leads are disposed on the surface of the substrate and are respectively electrically coupled to the corresponding heaters for conducting current into and out of the corresponding heaters respectively. The current conducted into and out of the heaters respectively run between adjacent two of the ink channels. The nozzle plate is disposed on the surface of the substrate and has a plurality of nozzles through the nozzle plate, and the positions of the nozzles are respectively corresponding to the positions of the heaters.

In the present invention, a plurality of ink channels through the substrate vertically is adopted for replacing the ink slot and for replacing or shortening the horizontal ink flow channels in the conventional technique. Thus, waste of the surface area of the substrate for forming elongated ink slot is reduced with the same printing resolution so that the manufacturing cost of the inkjet printhead is reduced. In other words, the densities of heaters on the substrate and nozzles are increased with the same surface area of the substrate so that the printing resolution and printing speed are improved.

In order to make the aforementioned and/or other objects, features and advantages of the present invention comprehensible, preferred embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," etc., is used with reference to the orientation of the Figure(s) being described. As such, the directional terminology is used for purposes of illustration and is in no way limiting. Also, it is to be understood that the phraseology and terminology used herein is for the purpose of description and should not be regarded as limiting. Therefore, unless limited otherwise, the terms "connected," "coupled," and "mounted" and variations thereof herein are used broadly and encompass direct and indirect connections, couplings, and mountings.

Figure 1:
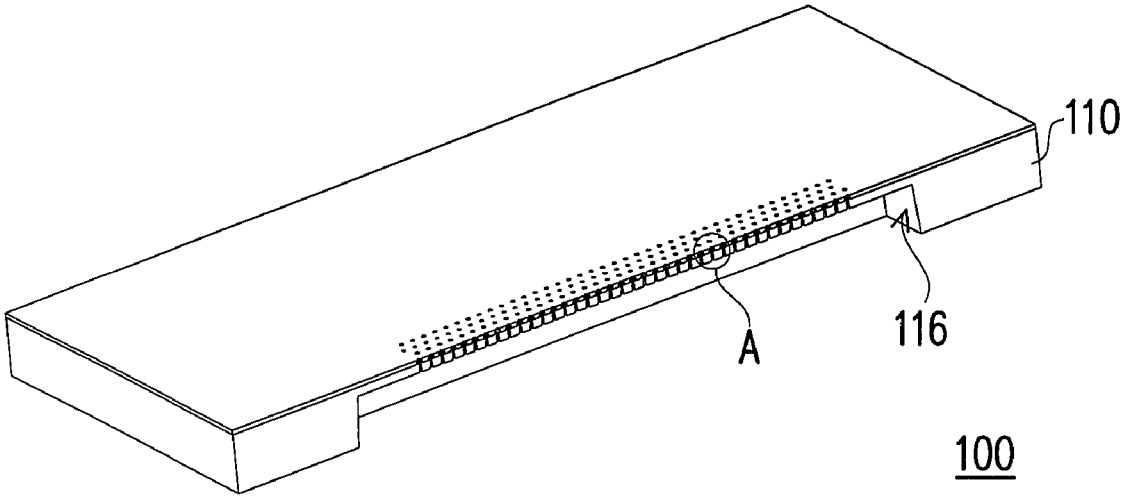
FIG. 1 is a perspective cross-sectional view of an inkjet printhead according to a first embodiment of the present invention.
Figure 2:
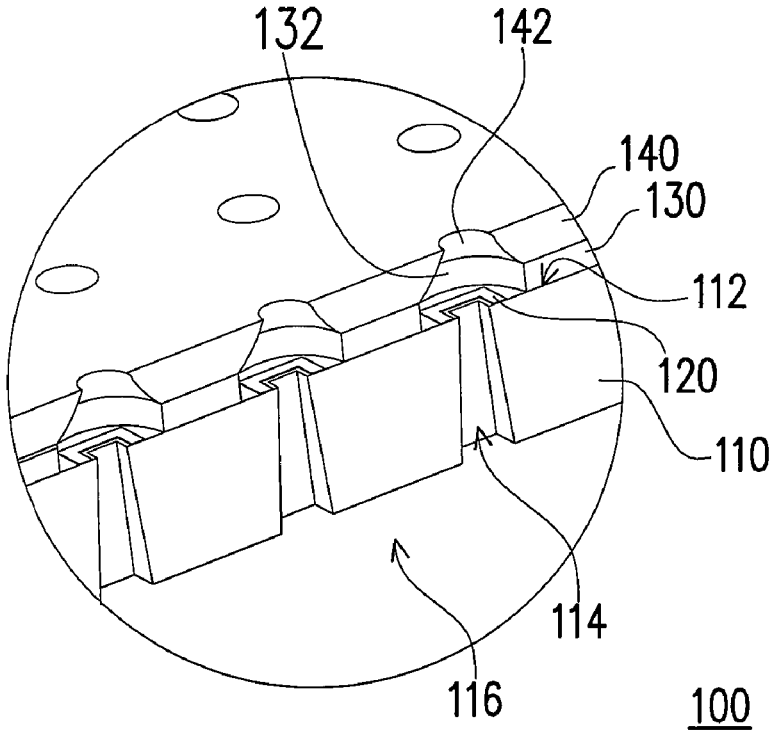
FIG. 2 is an enlarged view of area A in FIG. 1.

FIG. 1 is a perspective cross-sectional view of an inkjet printhead according to a first embodiment of the present invention, and FIG. 2 is an enlarged view of area A in FIG. 1. Referring to FIG. 1 and FIG. 2, in the present embodiment, the inkjet printhead 100 includes a substrate 110, a plurality of heaters 120, an ink chamber layer 130, and a nozzle plate 140.

The substrate 110 has a surface 112 and a plurality of ink channels 114 through the substrate 110 in the direction substantially vertical to the surface 112. The heater 120 and the ink chamber layer 130 are disposed on the surface 112 of the substrate 110. The heater 120 is usually defined by a resistive layer disposed on the surface 112 of the substrate 110 with leads electrically coupled to the resistive layer. In the first embodiment, the heater 120 surrounds the corresponding ink channel 114 in part, while in another embodiment, the heater 120 is adjacent to the corresponding ink channel 114 instead of surrounding it in part.

The ink chamber layer 130 has a plurality of ink chambers 132 respectively connected to the corresponding ink channels 114 and exposing the corresponding heaters 120 and the corresponding ink channels 114. In another embodiment, the heaters 120 may be covered by another protective layer (not shown), such as a SiN layer, a SiC layer, or a stack of SiN layer and SiC layer, to prevent the ink from corroding the underlying structure layers. Thus, in the present invention, the meaning of "the ink chamber 132 exposes the heater 120" or the like is not limited to the case that the ink chamber 132 exposes the corresponding heater 120 to air or out of the external surface of the substrate 110 but also includes the case that the ink chamber layer 130 does not directly cover the corresponding heater 120.

The nozzle plate 140 is disposed on the ink chamber layer 130 and has a plurality of nozzles 142 through the nozzle plate 140, and the positions of the nozzles 142 are respectively corresponding to the positions of the heaters 120. In another embodiment, the nozzle plate 140 and the ink chamber layer 130 may be integrally formed. In other words, the ink chambers 132 may be formed directly in the nozzle plate 140 corresponding to the nozzles 142, as disclosed in U.S. Pat. No. 6,209,203 for example.

Figure 3:
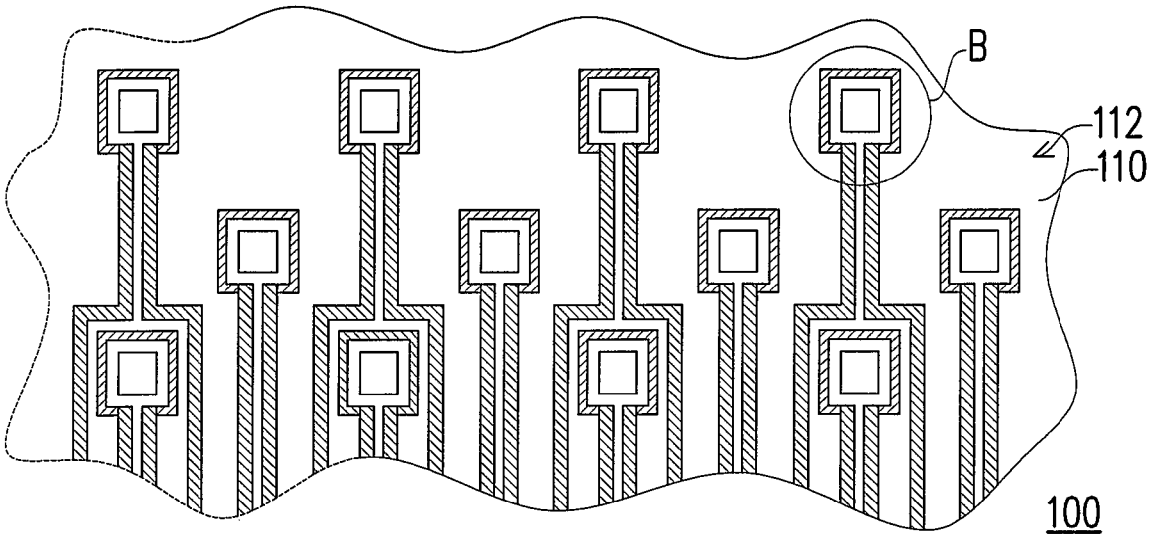
FIG. 3 is a partial top view of the inkjet printhead in FIG. 1 with its ink chamber layer and nozzle plate removed.
Figure 4:
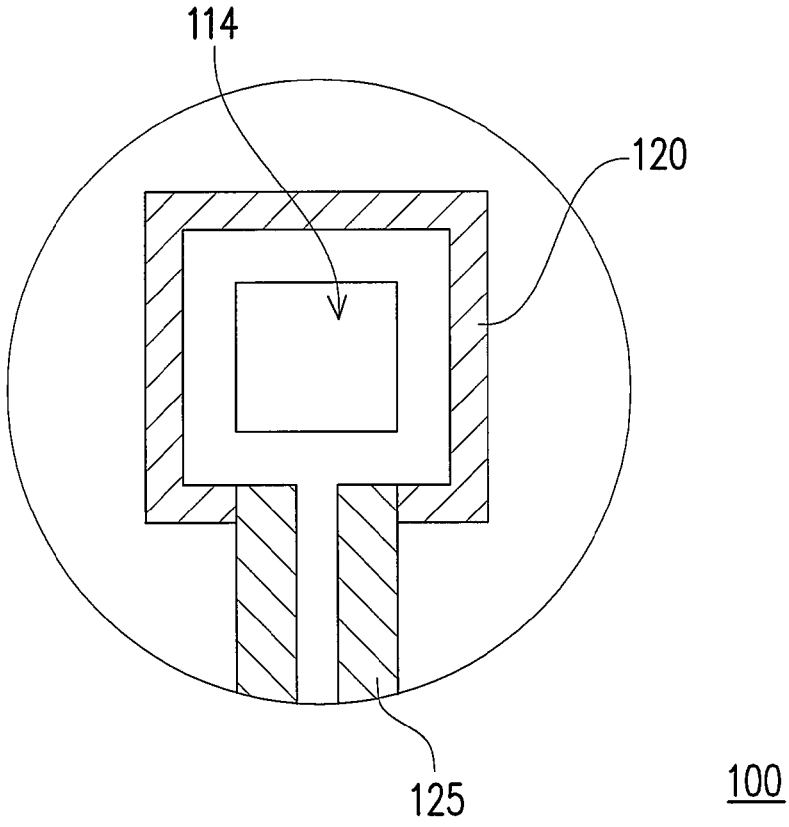
FIG. 4 is an enlarged view of area B in FIG. 3.

FIG. 3 is a partial top view of the inkjet printhead in FIG. 1 with its ink chamber layer and nozzle plate removed, and FIG. 4 is an enlarged view of area B in FIG. 3. Referring to FIG. 3 and FIG. 4, the inkjet printhead 100 further includes a plurality of leads 125 which are disposed on the surface 112 of the substrate 110 and are electrically coupled to the heaters 120 in pairs. One pair of leads 125 coupled to the same heater 120 respectively conduct current into and out of the heater 120, and this pair of leads 125 are located between the adjacent two of ink channels 114.

In another embodiment of the present invention, the lead 125 for conducting current into a corresponding heater 120 and the lead 125 for conducting current out of the same heater 120 are respectively located between different adjacent two of the ink channels 114 and are not necessarily to be between the same adjacent two of the ink channels 114. This will be described in details in the second embodiment illustrated in FIG. 5 and FIG. 6. Therefore, in the present invention, phrases such as "the lead for conducting current into the heater and the lead for conducting current out of the heater are respectively located between adjacent two of the ink channels" is not limited to being between the same adjacent two of the ink channels 114 but also include the case that the leads are respectively located between different adjacent two of the ink channels 114.

The persons skilled in the art may have the knowledge that another oxide layer and/or thin film layers (not shown) are disposed below the leads 125 or between the heaters 120 and the surface 112 of the substrate 110. Therefore, in the present invention, phase such as "being disposed on the surface 112 of the substrate 110" or the like is not limited to "being disposed directly on the surface 112 of the substrate 110" but also includes "being disposed indirectly on the surface 112 of the substrate 110". In other words, it may include the case that is being disposed on the thin film layers formed on the surface of the substrate.

When the lead 125 conducts current, the heater 120 converts the electrical energy provided by the lead 125 into heat energy and further vaporizes ink in the corresponding ink chamber 132 instantaneously so that ink can be ejected from the corresponding nozzle 142 of the nozzle plate 140 to form droplets of ink.

Referring to FIG. 1 and FIG. 2 again, to reduce the complexity in fabricating the substrate 110, the substrate 110 may further include an ink slot 116 connected to the ink channels 114. Specifically, the ink slot 116 is formed from the bottom of the substrate 110. The formation of the ink slot 116 facilitates ink to be supplied to the heaters 120 quickly. The ink channels 114 may be formed from the surface 112 towards the bottom of the substrate 110, or from the bottom towards the surface 112 of the substrate 110, before or after forming the ink slot 116.

Therefore, in the present invention, the meaning of the ink channels 114 through the substrate 110 or the like is not limited to the case that the ink channels 114 are directly from the top surface of the substrate 110 to the bottom surface of the substrate 110 (or from the bottom surface of the substrate 110 to the top surface of the substrate 110). It is within the scope of "the ink channels 114 through the substrate 110" or the like as long as ink can be vertically supplied from the bottom surface of the substrate 110 to the heaters 120 via the ink channels 114. For example, the ink channels may be formed from the surface 112 to certain thickness of the substrate 112 and fluidly connected to the bottom of the substrate 110 via the ink slot 116 (i.e. the ink channels 114 fluidly connect the top surface and the bottom surface of the substrate 110). In such an embodiment, the ink channels 114 are also through the substrate 110. The meaning of the ink channels 114 through the substrate 110 also includes the case that the vias or holes are formed at thin film layers between the substrate 110 and the resistive layer forming the heaters 120 and fluidly connected to the bottom of the substrate 110 via vias or holes or ink slot 116. In an embodiment of the present invention, the ink channels 114 may be formed by inductively coupled plasma (ICP), dry etching, or laser drilling, while the ink slot 116 may be formed by sandblasting or chemical etching; however, the present invention is not limited thereto.

Figure 5:
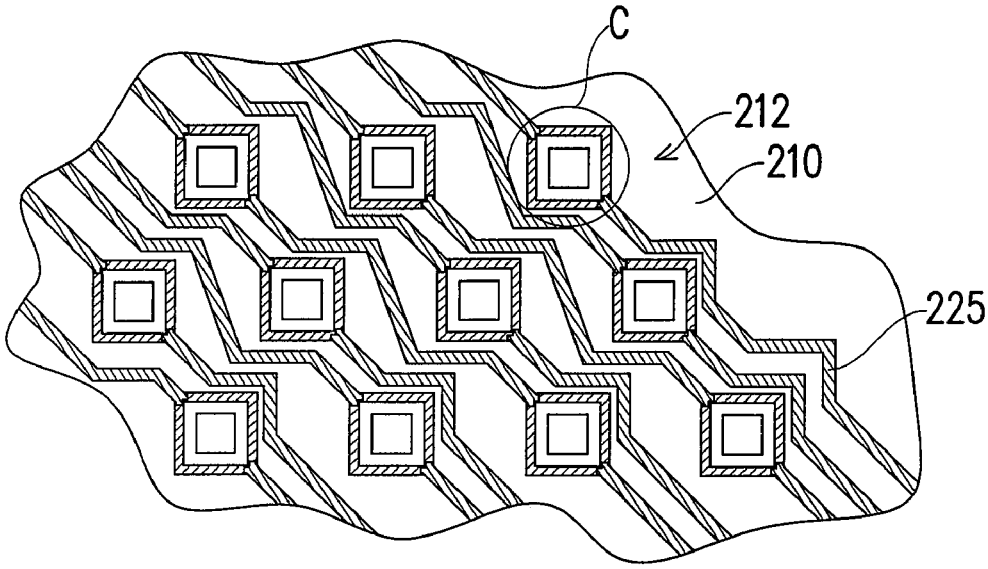
FIG. 5 is a partial top view of an inkjet printhead with its ink chamber layer and nozzle plate removed according to a second embodiment of the present invention.
Figure 6:
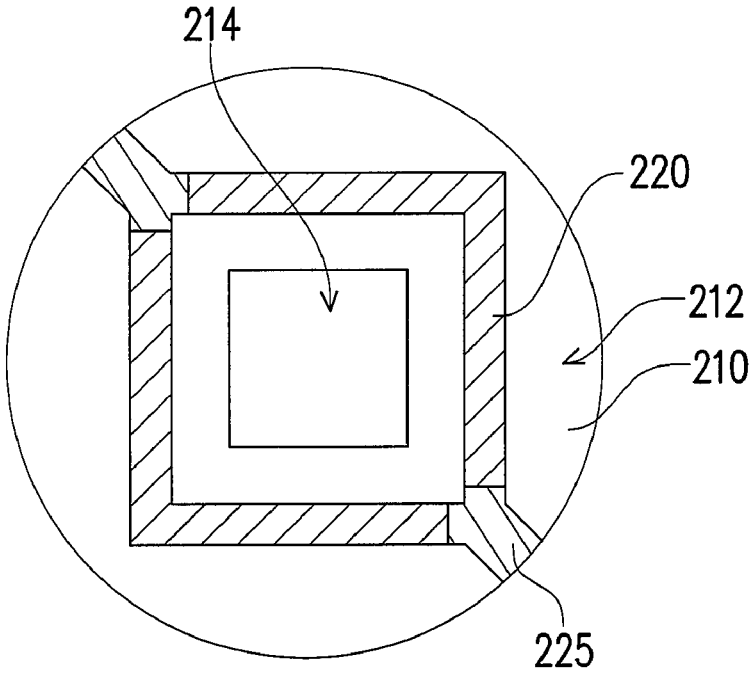
FIG. 6 is an enlarged view of area C in FIG. 5.

FIG. 5 is a partial top view of an inkjet printhead with its ink chamber layer and nozzle plate removed according to a second embodiment of the present invention, and FIG. 6 is an enlarged view of area C in FIG. 5. Referring to FIG. 5 and FIG. 6, in the present embodiment, the dispositions of the heaters 220, the leads 225, and the ink channels 214 on the surface 212 of the substrate 210 are slightly different from those in the first embodiment illustrated in FIG. 3 and FIG. 4.

In the first embodiment, a pair of leads 125 coupled to the same heater 120 is located between two of the ink channels 114 that are adjacent to each other (i.e. a pair of leads 125 coupled to the same heater 120 is located between the adjacent two of the ink channels 114). In other words, this pair of leads 125 is side by side extended to and coupled to the corresponding heater 120 and passes through the adjacent two of the ink channels 114. However, in the second embodiment, one lead of the pair of leads 225 coupled to the same heater 220, for example for conducting current to the heater 220, is extended between an adjacent two of the ink channels 214, while another one lead of the pair of leads 225 coupled to the same heater 220, for example for conducting current out of the heater 220, is extended between another adjacent two of the ink channels 214.

Additionally, in the second embodiment, a heater 220 and portions of a corresponding pair of leads 225 electrically coupled to the heater 220 surround the corresponding ink channel 214.

Although a heater 220 may be composed by electrically coupling two or more heating portions, it is still within the meaning of "portions of leads electrically coupled to the same heater and the heater surround the corresponding ink channel in part or entirely", namely, "the same heater" does not refer to only one heater, but may also be a set of heaters composed of two or more heaters or heating portions which are electrically coupled together.

Figure 7:
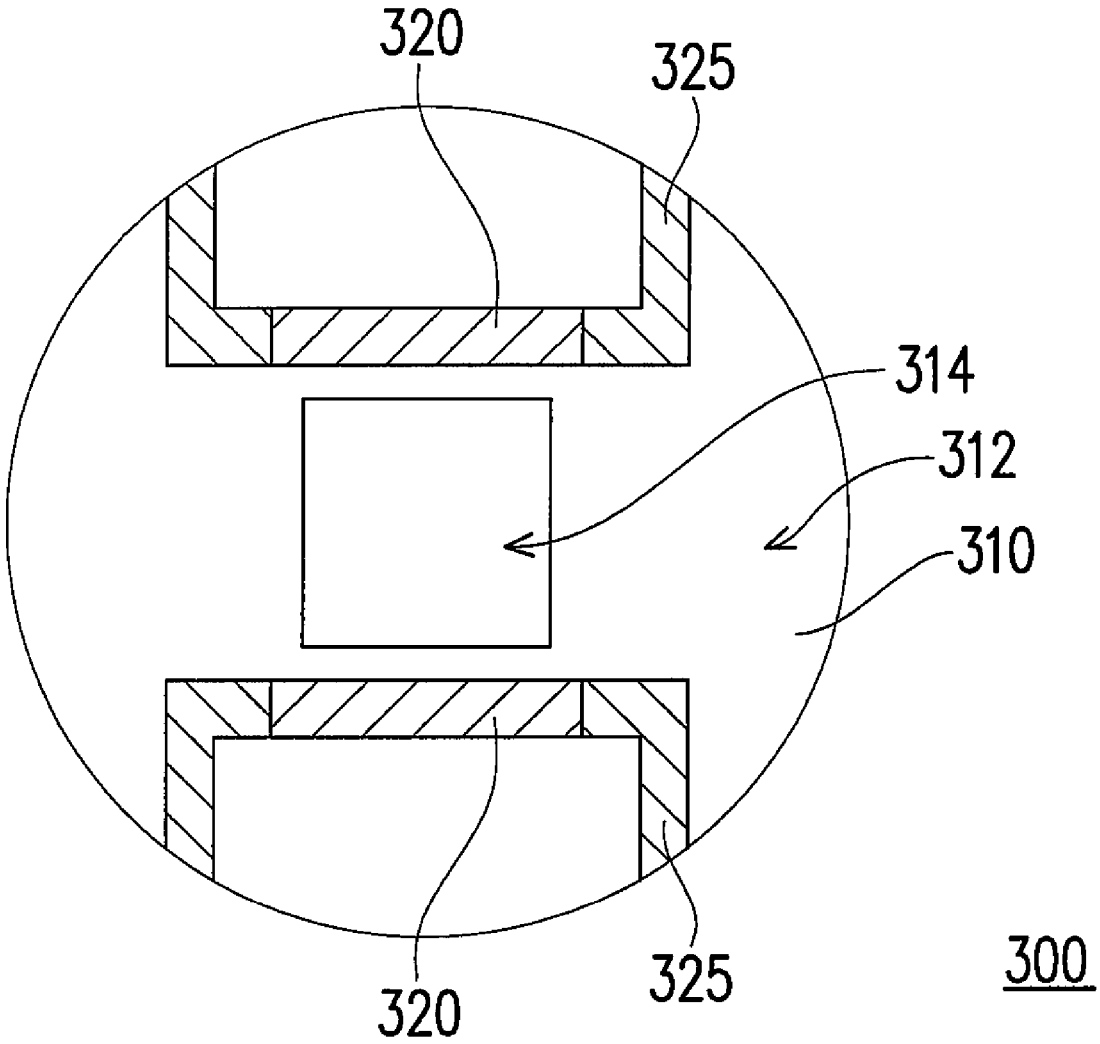
FIG. 7 is a partial top view of an inkjet printhead with its ink chamber layer and nozzle plate removed according to a third embodiment of the present invention.

FIG. 7 is a partial top view of an inkjet printhead with its ink chamber layer and nozzle plate removed according to a third embodiment of the present invention. Referring to FIG. 7, in the present embodiment, the dispositions of the heaters 320, the leads 325, and the ink channels 314 on the surface 312 of the substrate 310 are slightly different from those in the first embodiment illustrated in FIG. 4 and those in the second embodiment illustrated in FIG. 6.

In the third embodiment, two heaters 320 are separately disposed adjacent to the periphery of the corresponding common ink channel 314 so that the ink channel 314 can supply ink to the two heaters 320.

Figure 8:
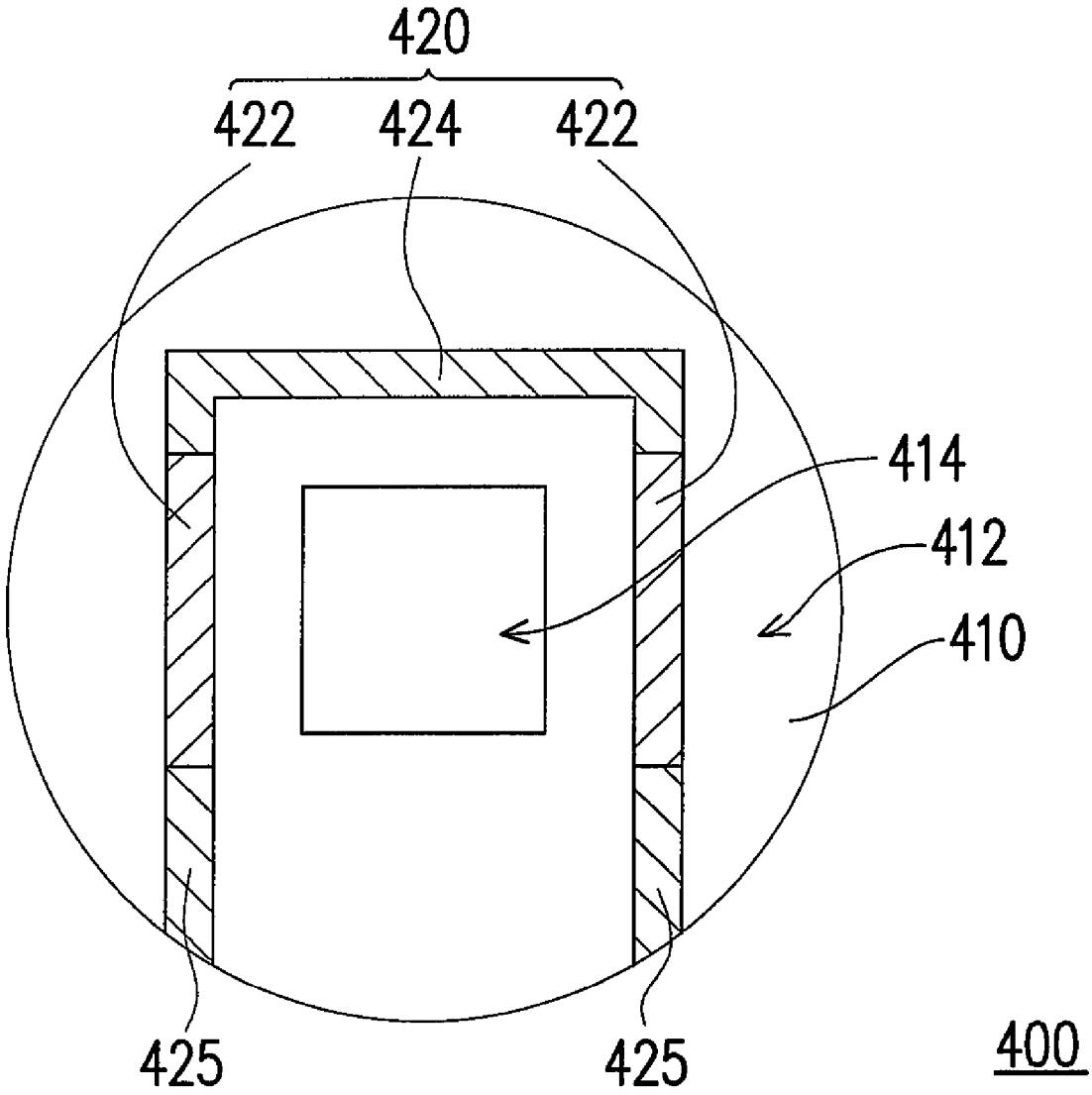
FIG. 8 is a partial top view of an inkjet printhead with its ink chamber layer and nozzle plate removed according to a fourth embodiment of the present invention.

FIG. 8 is a partial top view of an inkjet printhead with its ink chamber layer and nozzle plate removed, according to a fourth embodiment of the present invention. Referring to FIG. 8, not like in the third embodiment illustrated in FIG. 7 wherein two heaters 320 as well as the corresponding pairs of leads respectively coupled to the heaters 320 are disposed respectively at two sides of the same ink channel 314, in the fourth embodiment, the heater 420 is disposed on the surface 412 of the substrate 410 and surround the corresponding ink channel 414. The heater 420 includes two heating portions 422 and a lead 424. The two heating portions 422 are located respectively at two opposite sides of the ink channel 414, and the lead 424 electrically couples to the two heating portions 422. A pair of leads 425 is respectively coupled to the two heating portions 422 of the heater 420 for conducting current into and out of the heater 420 respectively.

In any one of the embodiments described above, the ink chambers do not have to be located right above the corresponding ink channels. In other words, the ink chambers and nozzles may or may not be located right above the ink channels; similarly, the nozzles may or may not be located right above the heaters.

Accordingly, in the present invention, when it describes that the positions of the nozzles are respectively corresponding to the positions of the heaters, it is not limited to the case that the nozzles have to be located right above the heaters. Additionally, the shape of the cross section of the ink channels may be square, rectangle, round, oval, or any other shape. When the shape of the cross section of the ink channels is round, the diameter of the ink channels is between about 5 microns and about 20 microns.

On the other hands, the leads electrically coupled to the heaters for conducting current into and out of the heaters do not have to be located at two portions of the same conductive layer which is one of multiple thin film layers for forming the inkjet printhead (inkjet chip), but may be formed at different layers of the inkjet printhead (inkjet chip).

In the embodiments of the present invention, a heater corresponding to a nozzle in the nozzle plate may be composed by electrically coupling two or more separate heating portions (i.e. the same heater set) through leads or conductors, and current may enter the heater via the lead coupled to the input terminal of one of the heating portion and flow out the heater via the lead coupled to the output terminal of the other heating portion. Accordingly, "a pair of leads" referred in the present invention does not mean that the same heater set can only have two leads (for conducting current in and out).

In the embodiments of the present invention, the distance between an edge of a heater close to a corresponding ink channel and the corresponding ink channel is between about 2 microns and about 80 microns, preferably between about 2 microns and about 40 microns. The heaters do not necessarily surround the corresponding ink channel entirely or in part. In another embodiment, one lead electrically couples to the heater for conducting current into the heater, the heater, and another lead electrically couples to the heater for conducting current out of the heater surround the corresponding ink channel entirely or in part. Moreover, a short horizontal ink flow channel that is substantially parallel to the horizontal surface of the substrate may be formed between the corresponding heater and the corresponding ink channel in the ink chamber layer according to the design requirement.

In summary, in the embodiments of the present invention, a plurality of ink channels running through the substrate substantially vertically is adopted for replacing the ink slot and for replacing and shortening the horizontal ink flow channels in the conventional technique. Thus, waste of the surface area of the substrate for forming elongated ink slot is reduced so that the manufacturing cost of the inkjet printhead is reduced. In other words, the densities of heaters and nozzles are increased with the same surface area of the substrate so that the printing resolution and printing speed are improved.

The foregoing description of the preferred embodiment of the present invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Additionally, the abstract of the disclosure is provided to comply with the rules requiring an abstract, which will allow a searcher to quickly ascertain the subject matter of the technical disclosure of any patent issued from this disclosure. It is submitted with the understanding that it will not be used to interpret or limit the scope or meaning of the claims. It is understood that certain terminology used herein is used for the purpose of describing particular embodiments only and are not intended to be limiting. For example, as used in this specification and the appended claims, the singular forms "a," "an," "at least one," and "the" may include plural referents unless the context clearly dictates otherwise. Any advantages and benefits described may not apply to all embodiments of the invention. It should be appreciated that variations may be made in the embodiments described by persons skilled in the art without departing from the scope of the present invention as defined by the following claims. For example, in the embodiments of the present invention, wherein the heater surrounds the corresponding ink channel in part or entirely, the lead electrically coupled to the heater for conducting current into the heater and the lead electrically coupled to the heater for conducting current out of the heater are not necessary to be arranged adjacent to each other and side by side. Moreover, no element and component in the present disclosure is intended to be dedicated to the public regardless of whether the element or component is explicitly recited in the following claims. These claims may refer to "an" element or "a first" element or the equivalent thereof. Such claims should be understood to include incorporation of one or more such elements, neither requiring nor excluding two or more such elements.

What is claimed is:

1. An inkjet printhead, comprising:

a substrate having a surface and a plurality of ink channels through the substrate in the direction substantially vertical to the surface;

a plurality of heaters disposed on the surface of the substrate and respectively adjacent to the corresponding ink channels;

a plurality of pairs of leads disposed on the surface of the substrate and each pair of leads coupled to a corresponding one of the heaters for conducting current into and out of the corresponding one of heaters respectively, wherein a part of the pair of leads for conducting current into the corresponding one of the heaters and another part of the pair of leads for conducting current out of the same corresponding one of heaters are respectively located between adjacent two of the ink channels; and a nozzle plate disposed on the surface of the substrate and having a plurality of nozzles through the nozzle plate, and the positions of the nozzles being respectively corresponding to the positions of the heaters.

2. The inkjet printhead as claimed in claim 1, wherein the substrate further comprises at least one ink slot fluidly connected to the ink channels.

3. The inkjet printhead as claimed in claim 1, wherein at least one of the ink channels supplies ink to at least two of the heaters adjacent to the ink channel.

4. The inkjet printhead as claimed in claim 1, wherein the heaters respectively surround the corresponding ink channels at least in part.

5. The inkjet printhead as claimed in claim 1, wherein parts of the pair of leads electrically coupled to the same heater for conducting current into and out of the same heater respectively and the heater itself surround the corresponding ink channel at least in part.

6. The inkjet printhead as claimed in claim 1, wherein parts of the pair of leads electrically coupled to the same heater for conducting current into and out of the same heater respectively and the heater itself surround the corresponding ink channel entirely.

7. The inkjet printhead as claimed in claim 1 further comprising:

an ink chamber layer disposed on the surface of the substrate and having a plurality of ink chambers respectively exposing the corresponding heaters and the corresponding ink channels, and the nozzle plate being disposed on the ink chamber layer.

8. The inkjet printhead as claimed in claim 1, wherein the nozzle plate has ink chambers respectively corresponding to the nozzles and exposing the heaters.

9. An inkjet printhead, comprising:

a substrate having a top surface and a bottom surface and a plurality of ink channels through the substrate in the direction substantially vertical to the top surface and the bottom surface;

a plurality of heaters disposed on the top surface of the substrate and respectively adjacent to the corresponding ink channels;

a plurality of pairs of leads disposed on the top surface of the substrate and each pair of leads electrically coupled to a corresponding one of the heaters for conducting current into and out of the corresponding one of heaters respectively; and a nozzle plate disposed on the top surface of the substrate and having a plurality of nozzles through the nozzle plate, and the positions of the nozzles being respectively corresponding to the positions of the heaters.

10. The inkjet printhead as claimed in claim 9, wherein the heaters respectively surround the corresponding ink channels at least in part.

11. The inkjet printhead as claimed in claim 9 further comprising:

an ink chamber layer disposed on the top surface of the substrate and having a plurality of ink chambers respectively exposing the corresponding heaters and the corresponding ink channels, and the nozzle plate being disposed on the ink chamber layer.

12. The inkjet printhead as claimed in claim 9, wherein the nozzle plate has ink chambers respectively corresponding to the nozzles and exposing the heaters.

13. The inkjet printhead as claimed in claim 9, wherein the distance between an edge of one of the heaters close to the corresponding ink channel and the corresponding ink channel is between about 2 microns and about 80 microns.

14. An inkjet printhead, comprising:

a substrate having a surface and a plurality of ink channels through the substrate in the direction substantially vertical to the surface;

a plurality of heaters disposed on the surface of the substrate and respectively adjacent to the corresponding ink channels;

a plurality of pairs of leads disposed on the surface of the substrate and each pair of leads electrically coupled to a corresponding one of the heaters for conducting current into and out of the corresponding one of heaters respectively, wherein parts of the pair of leads electrically coupled to the same heater for conducting current into and out of the same heater respectively and the heater itself surround the corresponding ink channel at least in part; and a nozzle plate disposed on the surface of the substrate and having a plurality of nozzles through the nozzle plate, and the positions of the nozzles being respectively corresponding to the positions of the heaters.

15. The inkjet printhead as claimed in claim 14, wherein the part of the pair of leads for conducting current into the corresponding one of the heaters and the part of the pair of leads for conducting current out of the same corresponding one of heaters are respectively located between adjacent two of the ink channels.

16. The inkjet printhead as claimed in claim 14 further comprising:

an ink chamber layer disposed on the surface of the substrate and having a plurality of ink chambers respectively exposing the corresponding heaters and the corresponding ink channels, and the nozzle plate being disposed on the ink chamber layer.

17. The inkjet printhead as claimed in claim 14, wherein the nozzle plate has a plurality of ink chambers respectively corresponding to the nozzles and exposing the heaters.

18. The inkjet printhead as claimed in claim 14, wherein the distance between an edge of one of the heaters close to the corresponding ink channel and the corresponding ink channel is between about 2 microns and about 80 microns.

19. An inkjet printhead, comprising:

a substrate having a surface and a plurality of ink channels through the substrate in the direction substantially vertical to the surface;

a plurality of heaters disposed on the surface of the substrate and respectively adjacent to the corresponding ink channels;

a plurality of pairs of leads disposed on the surface of the substrate and each pair of leads respectively electrically coupled to a corresponding one of the heaters for conducting current into and out of the corresponding one of the heaters, wherein current conducted into and out of the heaters respectively run between adjacent two of the ink channels; and a nozzle plate disposed on the surface of the substrate and having a plurality of nozzles through the nozzle plate, and the positions of the nozzles being respectively corresponding to the positions of the heaters.

20. The inkjet printhead as claimed in claim 19 further comprising:

an ink chamber layer disposed on the surface of the substrate and having a plurality of ink chambers respectively exposing the corresponding heaters and the corresponding ink channels, and the nozzle plate being disposed on the ink chamber layer.

21. The inkjet printhead as claimed in claim 19, wherein the nozzle plate has a plurality of ink chambers respectively corresponding to the nozzles and exposing the heaters.

22. The inkjet printhead as claimed in claim 19, wherein the distance between an edge of one of the heaters close to the corresponding ink channel and the corresponding ink channel is between about 2 microns and about 80 microns.

23. The inkjet printhead as claimed in claim 19, wherein at least one of the ink channels supplies ink to a first heating portion and a second heating portion of the corresponding one of heaters, the leads of one of the lead pairs are respectively electrically coupled to the first heating portion and the second heating portion in series for respectively conducting current into and out of the first heating portion and the second heating portion, current conducted into the first heating portion runs between adjacent two of the ink channels, and current conducted out of the second heating portion runs between adjacent two of the ink channels.

* * * * *